US008235557B2

(12) United States Patent
Brown

(10) Patent No.: US 8,235,557 B2
(45) Date of Patent: Aug. 7, 2012

(54) MODULAR CUSTOMIZABLE LAMPSHADE SYSTEM

(76) Inventor: Margaret A. Brown, Milwaukee, WI (US)

( * ) Notice: Subject to any disclaimer, the term of this patent is extended or adjusted under 35 U.S.C. 154(b) by 118 days.

(21) Appl. No.: 12/481,243

(22) Filed: Jun. 9, 2009

(65) Prior Publication Data

US 2010/0309670 A1 Dec. 9, 2010

(51) Int. Cl.
*F21V 1/06* (2006.01)

(52) U.S. Cl. ..... 362/352; 362/351; 362/403; 362/408; 362/441; 362/353; 362/354; 362/355; 362/356; 362/357

(58) Field of Classification Search ..... 362/351–361, 362/403, 408, 410, 441, 442
See application file for complete search history.

(56) References Cited

U.S. PATENT DOCUMENTS

| | | | | |
|---|---|---|---|---|
| 3,600,572 | A | 8/1971 | Grunwald | |
| 4,685,038 | A * | 8/1987 | Huang | 362/352 |
| 5,311,415 | A | 5/1994 | Hyland | |
| 5,662,412 | A * | 9/1997 | Glendmyer | 362/351 |
| 5,868,492 | A * | 2/1999 | Strickland | 362/352 |
| 6,439,736 | B1 | 8/2002 | Fiene | |
| 6,561,682 | B1 | 5/2003 | Juang | |
| 6,652,126 | B2 | 11/2003 | Lu | |
| 6,663,263 | B2 | 12/2003 | Yu | |
| 6,746,137 | B1 * | 6/2004 | Yeh | 362/352 |
| 6,786,621 | B2 * | 9/2004 | Sviland | 362/351 |
| 6,869,207 | B2 | 3/2005 | Lee | |
| 6,997,581 | B1 * | 2/2006 | Shelton et al. | 362/359 |
| 7,267,458 | B2 * | 9/2007 | Bin | 362/352 |
| 7,399,091 | B2 * | 7/2008 | Lockett et al. | 353/120 |
| 7,497,602 | B2 * | 3/2009 | Lien | 362/352 |
| 2004/0076012 | A1 | 4/2004 | Pazula et al. | |
| 2004/0114373 | A1 * | 6/2004 | Lin | 362/352 |
| 2004/0125604 | A1 * | 7/2004 | Yeh | 362/352 |
| 2008/0074890 | A1 * | 3/2008 | Swanson | 362/351 |
| 2008/0192487 | A1 * | 8/2008 | Giegerich et al. | 362/352 |
| 2009/0196051 | A1 * | 8/2009 | Dick et al. | 362/351 |

OTHER PUBLICATIONS

Moon Shine Lamp and Shade, Retrieved from <http://www.moonshineshades.com> on Jun. 11, 2009.
Custom Lampshades, Fenchel Custom Lamp Shades, Retrieved from <http://www.fenchelshades.com> on Jun. 11, 2009.
Marcia Pleger, Bright Idea, Cleveland.com, Retrieved from <http://blog.cleveland.com/business/2008/10/bright_ideas_a_monthly_feature_2.html>, Oct. 7, 2008.

* cited by examiner

*Primary Examiner* — Diane Lee
*Assistant Examiner* — Jessica M Apenteng
(74) *Attorney, Agent, or Firm* — Boyle Fredrickson, S.C.

(57) ABSTRACT

A lampshade system which utilizes a simplified lampshade design that does not require integrally manufactured frame components. The lampshade can be manufactured in a flattened position to optimize shipping, storage and display space and which may be easily assembled into a three-dimensional lampshade position by an end user at the point of use.

11 Claims, 5 Drawing Sheets

MODULAR CUSTOMIZABLE LAMPSHADE SYSTEM

FIELD OF INVENTION

This invention relates generally to the field of lampshades, and more specifically to a lampshade system which does not require integrally manufactured frame components.

BACKGROUND

Conventional lampshades are generally bulky and hollow structures that are comprised of a fabric material. The fabric material includes internal frame components that have been integrally manufactured with the fabric material to provide structural support and rigidity to form a lampshade. The internal frame of the lampshade also allows the lampshade to be attached to a lamp base.

SUMMARY OF THE INVENTION

The present invention is a lampshade system and apparatus that enables a lamp shade to be manufactured, shipped, and stored in a flattened position to reduce freight, distribution and display costs. The invention disclosed herein is a lampshade apparatus and system including a sheet lampshade and a supporting lampshade spider collar configured to receive the sheet lampshade. The lampshade apparatus and system described herein may be assembled at the point of use by the end user to eliminate final assembly costs. The invention may be constructed in a range of shapes and sizes and of materials having various textures colors, photos, graphics, themes, decorative treatments, cut-out portions, openings and embellishments and licensed designs and characters.

The sheet lampshade component of the system described herein may be cut, tooled or otherwise manufactured from a sheet of heat resistant material or heat-safe material. Various embodiments of the sheet lampshade component may include interlocking tabs or other securing components to hold the edges of the sheet lampshade together and cause the sheet lampshade to indefinitely retain its cylindrical or conical shape. In various embodiments of the invention, the sheet lampshade can later be disassembled to bring the lampshade to its original substantially flat status.

Other embodiments of the sheet lampshade system described herein may further utilize a lampshade spider collar component comprised of a plurality of telescoping pieces, with a vertical stop component at each end of the telescoping pieces. In various embodiments the lampshade spider collar component may be made of rigid or semi-rigid heat-resistant material. The lampshade spider collar component may be comprised of a central ring with a plurality of identical telescoping arms radiating at equal intervals from its edges. Various embodiments may feature more or fewer telescoping arms, with each arm further including a stop (e.g., a substantially rectangular protuberance) located at each end to further secure the sheet lampshade component in place when the sheet lampshade component is in an assembled position. In still other embodiments, each protuberance (stop) may be further adapted for insertion into slits or holes in the sheet lampshade (the slits or holes being formed by a die cut process or other cutting process). Stops may be rectangular, triangular, hook-shaped or rounded. In other embodiments, telescoping members of the lampshade spider collar component may be easily disassembled for packaging.

It should therefore be appreciated that the sheet lampshade system reduces or eliminates the special machinery or manual labor required to assemble lampshade components in a factory; reduces the space requirements and associated shipping costs for delivering conventional lampshades to consumers; and increases the quantity of lampshade styles that retailers can display to consumers.

DETAILED DESCRIPTION OF INVENTION

Figure 1:
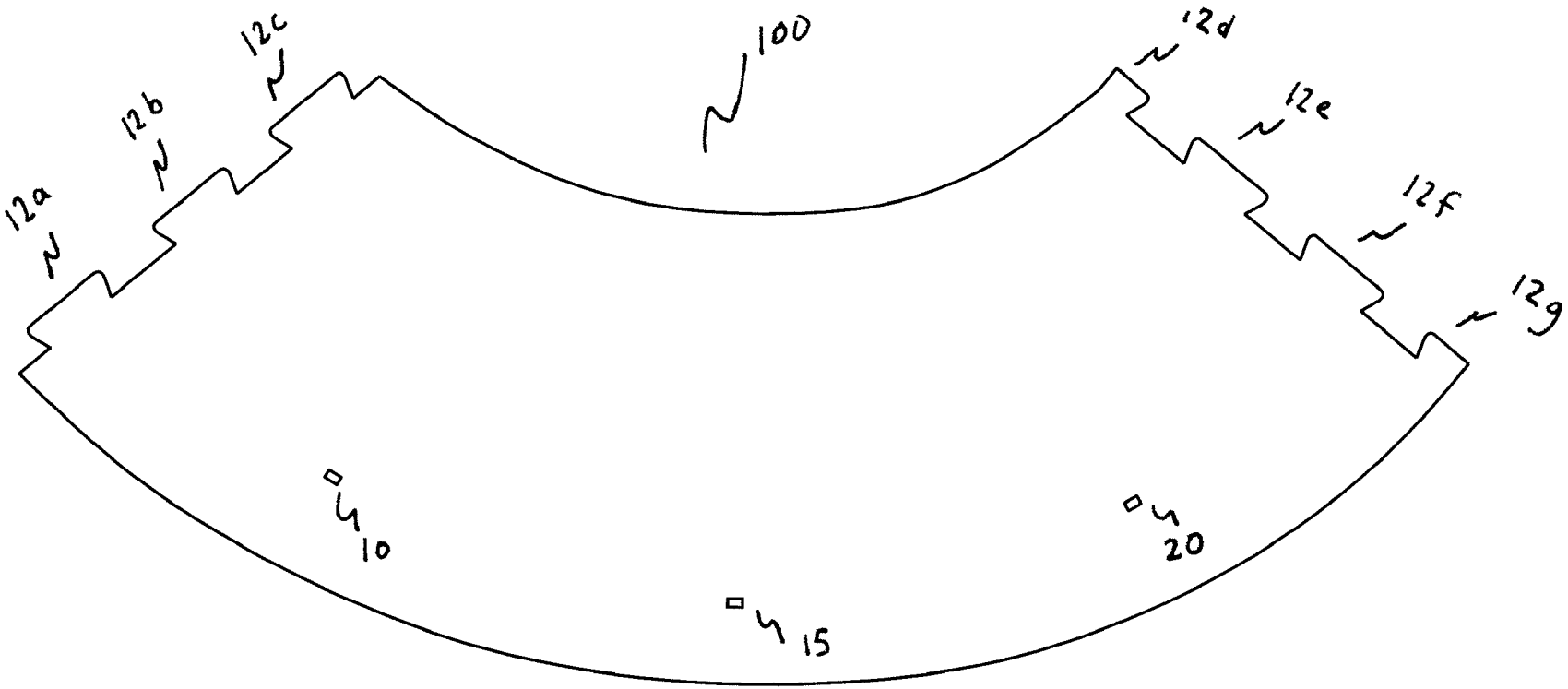
FIG. 1 illustrates a sheet lampshade component in a flattened position with interlocking tabs in accordance with one embodiment.

The sheet lampshade system includes a semi-rigid and flexible sheet lampshade component which provides the shape for an apparatus used to cover or partially cover the light source component of a lamp in one embodiment. The sheet lampshade may include layers of fabric, plastic, paper, wallpaper, adhesives, paint, photographic images, memorabilia and any other materials capable of creating a decorative or aesthetic effect. The sheet lampshade may be constructed of plastic, nylon, paper, fabric, styrene or any other material which is capable of being stored, embellished, machined or cut in a flattened position and which can be manipulated and/or curved to form any round, cuboid, square, rectangular, conical, cylindrical, irregular, or asymmetrical shape structure which can function as a lampshade. The sheet lampshade is further capable of functioning as three-dimensional lampshade structure without integrally manufactured frame components or support components to hold its shape (i.e., has sufficient rigidity to do so). The sheet lampshade may be formed from multiple parts which are joined to form the sheet lampshade, and may also include flexible or jointed components which cause the sheet lampshade to collapse, fold, or become flexible. The sheet lampshade may also include apertures, textures, grooves, or aesthetic and structural components which do not alter its functionality as a sheet lampshade to be used on a lamp.

In various embodiments, the sheet lampshade component may be of various shapes and sizes, and may be used with a conventional table lamp, floor lamp or as a component of any other lighting fixture or lantern, luminary or lighting fixture. The sheet lampshade system may comprise a sheet lampshade and may also include, among other components, a fixed or expandable lampshade spider collar component.

In one embodiment, a lampshade spider collar component includes a structure or ring which is selectively attachable to a lamp between the base and the light bulb (or other illuminating component serving an equivalent function), and which may be secured to a lamp base. The lampshade spider collar component can be used alone or in conjunction with other components to support the sheet lampshade component. In one embodiment, the lampshade spider collar component includes at least one telescoping arm, with a vertical stop component at the end of the telescoping arm. In one embodiment, the lampshade spider collar component may include a central ring with a plurality of identical telescoping arms radiating at equal intervals from its edges (or at any suitable interval). Each arm includes a small protuberance (or stop) protruding substantially perpendicularly from its outer edge (or at any other suitable angle), which is used for insertion into slits or holes located in a sheet lampshade component. Various embodiments of the lampshade spider collar component may be telescoping to allow the lampshade spider collar component to support and accommodate the different sizes and shapes of a particular sheet lampshade component which can be assembled and placed over the lampshade spider collar component. Various embodiments of the lampshade spider collar component may have more or fewer telescoping arms.

Figure 3:
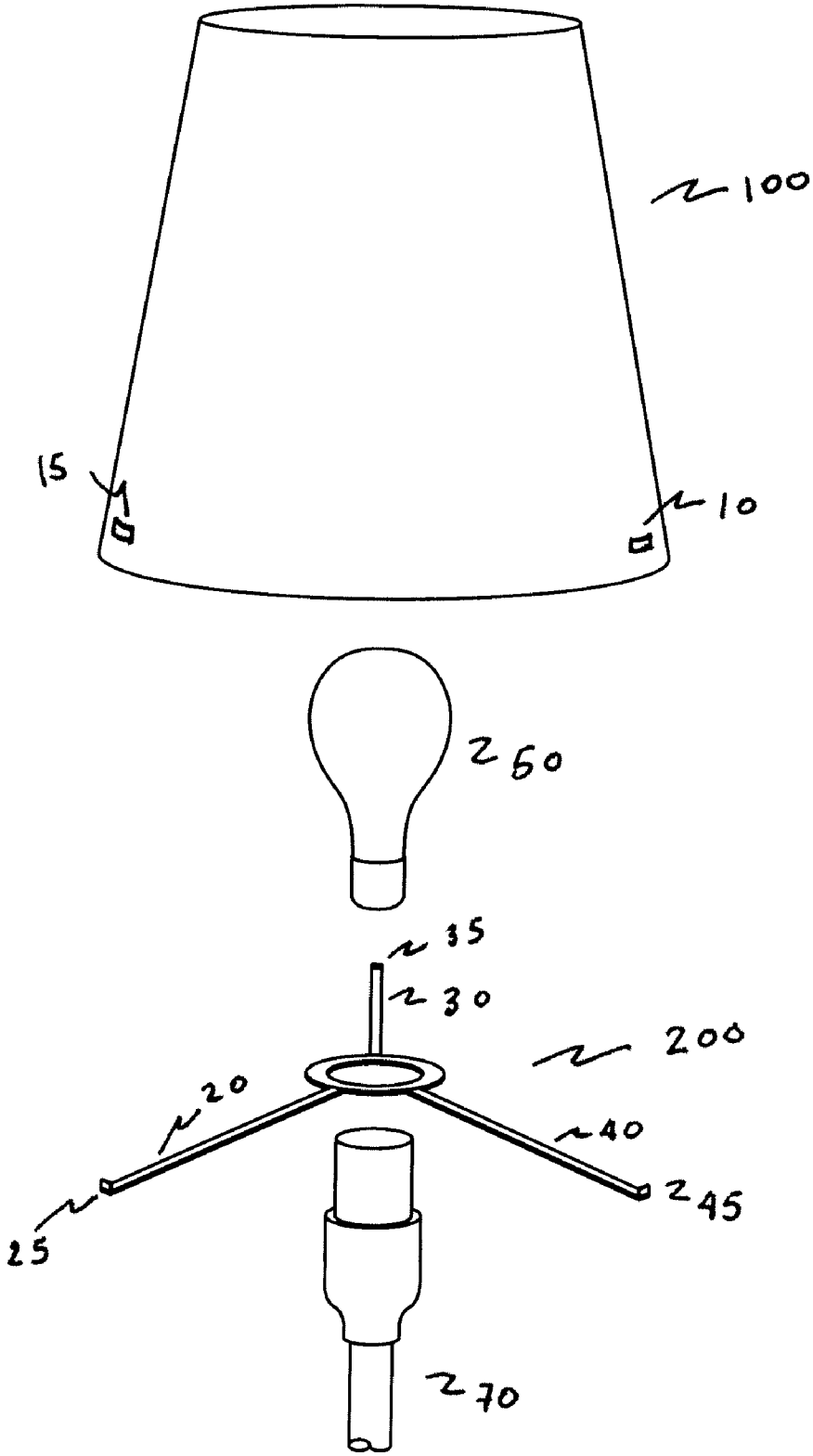
FIG. 3 is an exploded view of the sheet lampshade component in the assembled position, a light bulb, a lampshade spider collar component and a lamp base in accordance with one embodiment.

FIG. 1 illustrates one embodiment of a sheet lampshade 100 in a flattened or unrolled position. While in a flattened or unrolled position, sheet lampshade 100 can be advantageously laid flat on a surface in preparation for cutting, feeding through a machine roller or other suitable manner of tooling, stacking, layering, storage, shipping and/or packaging. Sheet lampshade 100 includes seven interlocking tabs 12*a*-12*g* on opposite ends of the sheet lampshade 100. Alternative sheet lampshade embodiments may include more or fewer tabs. In one embodiment, the tabs are interlocking with other tabs (e.g., on opposite ends of the sheet lampshade 100), which allows a user to roll and maintain sheet lampshade 100 in a three-dimensional position (as shown in FIG. 3). Alternatively, the tabs can be configured for insertion into slits, contours, or other suitable securing mechanisms on opposite ends of the sheet lampshade 100. Alternate securing members may also be incorporated into the sheet lampshade (in addition to or as a substation to the tabs) to secure the opposite ends of the sheet lampshade such as adhesives, snaps, hooks, suction cups, tape, gel, putty, pins, loops, ties, contoured interlocking components, hook-and-loop fabric, or any other suitable securing materials.

Figure 2B:
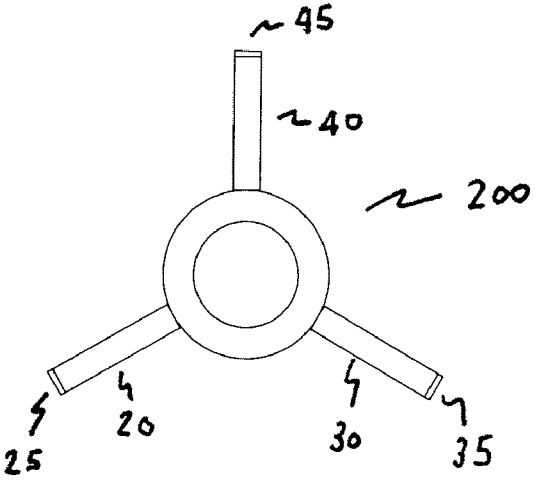
FIGS. 2A and 2B illustrate a lampshade spider collar component in two positions in accordance with one embodiment.
Figure 2A:
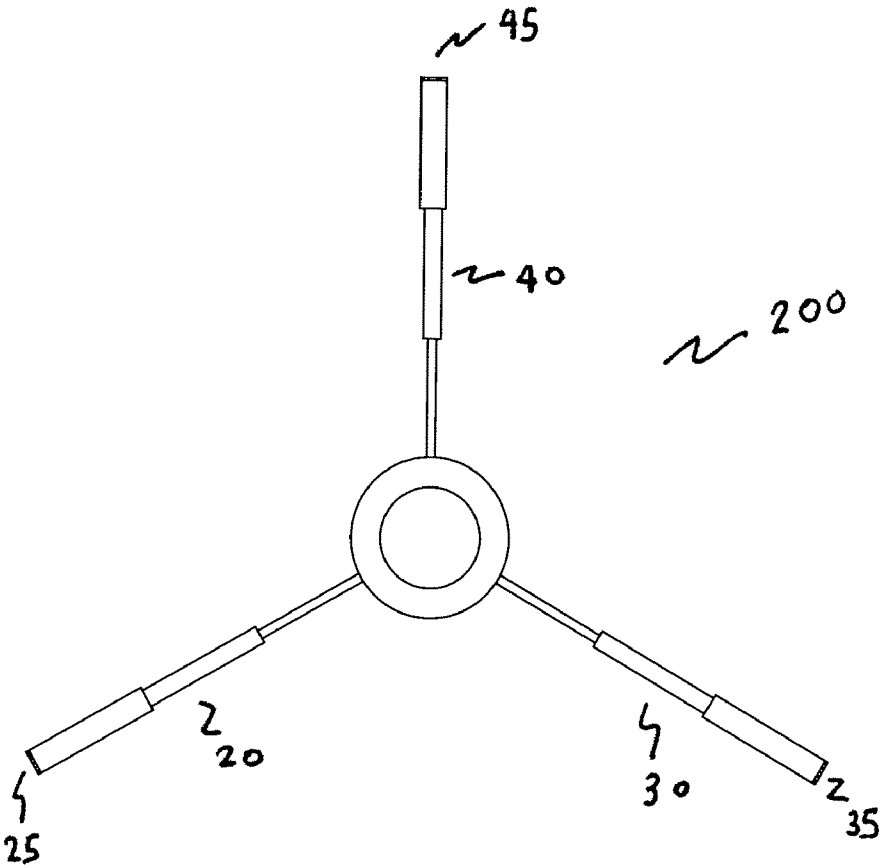

In the embodiment shown, the sheet lampshade includes apertures 10, 15, 20 or slots for coupling to stops of a lampshade spider collar component (shown in FIGS. 2A and 2B). Alternative embodiments may include more or fewer apertures or slots which may be of any suitable shape or size, or may alternately employ grooves or protruding folding components configured to receive and/or complement a lampshade spider collar component. The apertures may also be positioned at any suitable location on the lampshade. In the embodiment shown, sheet lampshade 100 is configured to be rolled into a cylindrical shape position, but alternate embodiments may be rectangular, fluted, conical, cuboid, triangular, oval, squared, irregularly shaped, scalloped, or shaped to resemble any suitable object and/or character.

In one embodiment, sheet lampshade 100 is constructed of any suitable flexible, resilient, heat-resistant material known in the art which can be used to form a lamp shade structure. Materials used to form sheet lampshade 100 include, but are not limited to, styrene, other plastics, treated fabrics, treated paper products, composites, rubber, treated woods, aluminum or other metals and combinations of the foregoing. Any material may be used which is capable of being positioned and configured for use as a lampshade. In various embodiments, a sheet lampshade may be constructed of multiple components for aesthetic effect. Various materials used to form a sheet lampshade may be opaque, translucent, heat resistant, or any suitable combination. Still further embodiments of the sheet lampshade may be constructed of multiple layers (e.g., fabric, styrene, etc. . . . ) and may utilize a sheet lampshade as an internal support structure to support and adapt another object (e.g., a hat, a sack-like component, or any other suitable object) for aesthetic enhancement. The multiple layers may be permanently bonded or selectively detachable from each other to form the sheet lampshade component.

In one embodiment, sheet lampshade 100 is constructed from styrene sheet stock which may be rolled for storage and easily die cut in a substantially flattened position (or any other suitable position). In the embodiment shown, the material used for the sheet lampshade 100 is a flat sheet of flexible, translucent and heat-resistant material which can be transported in a substantially flattened position (or any other suitable position). When the sheet lampshade 100 reaches a retailer or a consumer, the sheet lampshade can be rolled to form a three-dimensional lampshade structure (however, it should be appreciated that the sheet lampshade can be assembled at any suitable time). The two ends of the sheet lampshade structure can be snapped together to maintain the three-dimensional lampshade structure by interlocking tabs 12*a*-12*g* along opposite edges of the sheet lampshade 100. Thus, in one embodiment, no tools and no fasteners are necessary to assemble the three-dimensional lampshade structure. In alternative embodiment, the die-cut of the sheet lampshade can be varied to produce a wide selection of differently proportioned cylindrical and conical shades (or any other suitable shape).

In alternative embodiments, sheet lampshade 100 may be constructed of specially coated cardboards, photographic papers or other materials on which images may be printed or imposed. Printing units and machines may be specially configured to receive uncut material to form sheet lampshade 100, or to receive the sheet lampshade component after cutting. Any image known in the art capable of being reproduced on a surface may be used to enhance the appearance of sheet lampshade 100. In one embodiment, the image for the sheet lampshade may be printed on a first type of material (e.g., the material is better for printing/reproducing an image, but not strong enough to alone form and maintain the three-dimensional position of sheet lampshade 100). Before, during, or after the image is printed on the first type of material, the first type of material is coupled with a second type of material that can form and maintain the sheet lampshade in the three-dimensional position.

In one embodiment, the sheet lampshade system can be configured to allow a sheet lampshade purchaser to custom order sheet lampshade 100 with purchaser selected images. In one embodiment, custom orders are produced using just-in-time manufacturing. For example, a purchaser can visit a brick-and-mortor store or website on a computer to order a sheet lampshade with a custom image. The purchaser can select from any desired sheet lampshade style and provide/upload a custom image or photograph to the store employee or to the sheet lampshade ordering website. The sheet lampshade manufacturer can then print the purchaser's custom image on one or more sheet lampshades and provide or ship the final product to the purchaser. In an alternative embodiment, the brick-and-mortor store has all of the lampshade system components (e.g., sheet lampshade components, lampshade spider collars, lamp bases, etc. . . . ) and machinery to print custom images (e.g., photos, drawings, etc. . . . ) on sheet lampshades to form complete lamps. Thus, in this embodiment, a purchaser can bring a custom image to the brick-and-mortor store, select a sheet lampshade style, and have the custom image produced on the sheet lampshade component while the purchaser waits in the store. The purchaser can also form the sheet lampshade in the three-dimensional position with or without assistance from the brick-and-mortor store employees while waiting in the brick-and-mortor store (or form the sheet lampshade in the three-dimensional position at any suitable time). It should also be appreciated that all of the lamp components can be purchased at the store and the purchaser can form the complete lamp at the store or any other suitable time.

In another embodiment, purchaser accessible kiosks can be configured to produce the purchaser selected image on the sheet lampshades. The kiosk can be configured to capture the purchaser's selected sheet lampshade style and capture the custom image. The kiosk can then produce the selected sheet lampshade style with the purchaser's custom image and provide the sheet lampshade to the purchaser while the purchaser waits (e.g., within a few minutes or any other suitable amount of time).

In one embodiment, a custom image for the sheet lampshade 100 may be printed by a consumer on a material that is suitable for use in ink-jet printers, laser printers, or other suitable printers. In another embodiment, a custom image for the sheet lampshade 100 may be printed by a consumer on a first type of material (e.g., material that is suitable for use in ink-jet printers, laser printers, or other suitable printers) and coupled to a second material to form the sheet lampshade 100. The first material can be coupled to the second material after the consumer has printed the image on the first material to form a sheet lampshade with a custom image. In one embodiment, the first material can be bonded to the second material using a conventionally available heat source (e.g., iron on, or other suitable methods). In an alternative embodiment, the first material is removably coupled to the second material (e.g., the first and second materials can be separated or removed from each other). For example, the first material can be attached to the second material with a weak adhesive and can be separated from each other with a limited amount of force. In another such example, the first and second material can be removably coupled with electrostatic force. In yet another such example, the first material can be coupled to the second material with gravity (e.g., the first material slips over the second material when both are formed in the three-dimensional position and gravity keeps the first material coupled to the second material). It should be appreciated that any suitable method of coupling can be used.

FIGS. 2A and 2B illustrate a lampshade spider collar component 200 in two configurations. In the embodiment shown in FIGS. 2A and 2B, the lampshade spider collar component is expandable and includes telescoping arms 20, 30 and 40 which radiate outward from central ring structure 50. Other embodiments of the lampshade spider collar may utilize support structures which are not telescoping, or which may be folding or detachable. Various embodiments may include more or fewer telescoping arms and or ring structures which may be affixed or selectively attachable to one or more ring components 50.

FIG. 2A illustrates an expandable lampshade spider collar component with arms 20, 30 and 40 in the extended position to accommodate wider shades. In the embodiment shown, lampshade spider collar component 200 is made of rigid heat-resistant material and consists of a central ring with a plurality of identically sized telescoping arms 20, 30 and 40 radiating at equal intervals from its edges. Each arm has a stop 25, 35 and 45 which is a protruberance extending upward from its tip and adapted for insertion into or to otherwise secure a sheet lampshade (e.g., through apertures 10, 15, 20 as discussed above). The stop may be of various shapes or materials, including pointed, hook-shaped, rounded, or adapted to be secured with a permanent or temporary adhesive substance. In one embodiment, the stop can be configured to couple to a decorative element (e.g., a ball, character, a geometric shape, or any other suitable aesthetic enhancement). The decorative element can be coupled to the stop in any suitable manner from the outside of the sheet lampshade, before, during, or after the sheet lampshade is assembled in a three-dimensional position. In the embodiment shown, the expandable lampshade spider collar component may be sold as a standard-sized part, and which may be adjusted to accommodate the size and shape of various sizes and circumferences of sheet lampshades assembled by a consumer or an end user of the apparatus and system described herein.

FIG. 2B illustrates the the expandable lampshade spider collar component 200 with arms 20, 30 and 40 in a retracted position (i.e., a non-extended position) to accommodate narrower diameter sheet lampshade shapes. In alternate embodiments, the lampshade spider collar component may be non-adjustable and/or sold in various sizes and having arms 20, 30 and 40 of uniform or varying lengths, to accommodate various sheet lampshade configurations (e.g., square, rectangular, octagonal, etc. . . . ). In still other embodiments, arms 20, 30 and 40 may be detachable or curved.

FIG. 3 illustrates an exploded view of a lamp utilizing the sheet lampshade component system. Visible in FIG. 3 are sheet lampshade component 100, light bulb 50, a lampshade spider collar component 200 and lamp base 70. As shown in FIG. 3, lampshade spider collar component 200 is adapted to fit securely between light bulb 50 and lamp base 70. In one embodiment, the lampshade spider collar component 200 screws onto lamp base 70. In an alternative embodiment, the lampshade spider collar component 200 is secured to lamp base 70 when bulb 50 is coupled to lamp base 70. In another embodiment, the lampshade spider collar component 200 is coupled to lamp base 70 with a coupling nut such that the lampshade spider collar component 200 is sandwiched between lamp base 70 and the coupling nut (not shown). In the embodiment shown, lampshade spider collar component 200 includes telescoping arms 20, 30 and 40 (shown in a retracted position) which are adapted to secure various sized sheet lampshades.

Figure 4A:
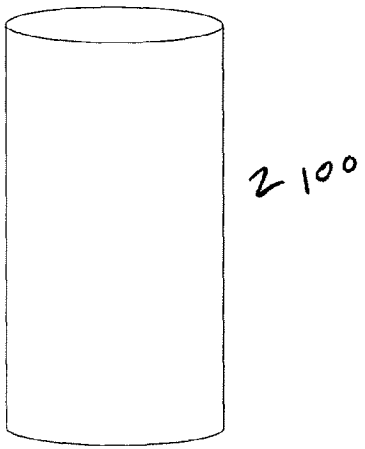
FIG. 4A illustrates a sheet lampshade component which is substantially cylindrical in accordance with one embodiment.

FIG. 4A illustrates one embodiment of sheet lampshade component which is substantially cylindrical and which has a smooth surface. This embodiment of the sheet lampshade component may be manufactured in various sizes, with the bottom circumference having varying dimensions.

Figure 4B:
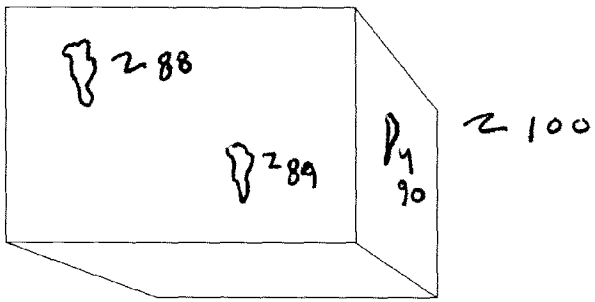
FIG. 4B illustrates a sheet lampshade component which has a cube shape in accordance with one embodiment.

FIG. 4B illustrates one embodiment of sheet lampshade component which has a square shape and which further includes apertures 88, 89, and 90 to allow light to pass through; however any suitable number of light apertures may be included. Alternate embodiments of any of the sheet lampshade components may be constructed of opaque, phosphorescent, or translucent materials, and various embodiments may consist of multiple layers of materials without altering the functionality of sheet lampshade component.

Figure 4C:
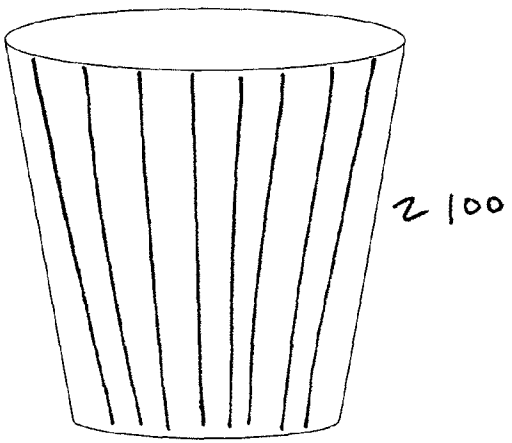
FIG. 4C illustrates a sheet lampshade component which has a conical shape in accordance with one embodiment.

FIG. 4C illustrates one embodiment of a sheet lampshade component which has a conical shape, and which further includes ridges, folds or contours formed by a heat press, folding, cutting, or any other suitable machining methods. In various embodiments, the sheet lampshade component may be scored for folding, perforated, or treated.

Figure 4D:
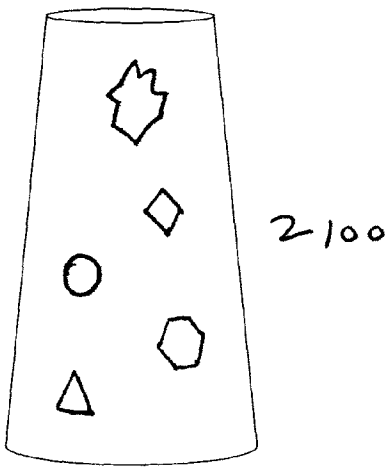
FIG. 4D illustrates a sheet lampshade component which has a narrow conical shape in accordance with one embodiment.

FIG. 4D illustrates one embodiment of a sheet lampshade component which has narrow conical shape, and includes heat-resistant decorative embellishments.

Figure 5:
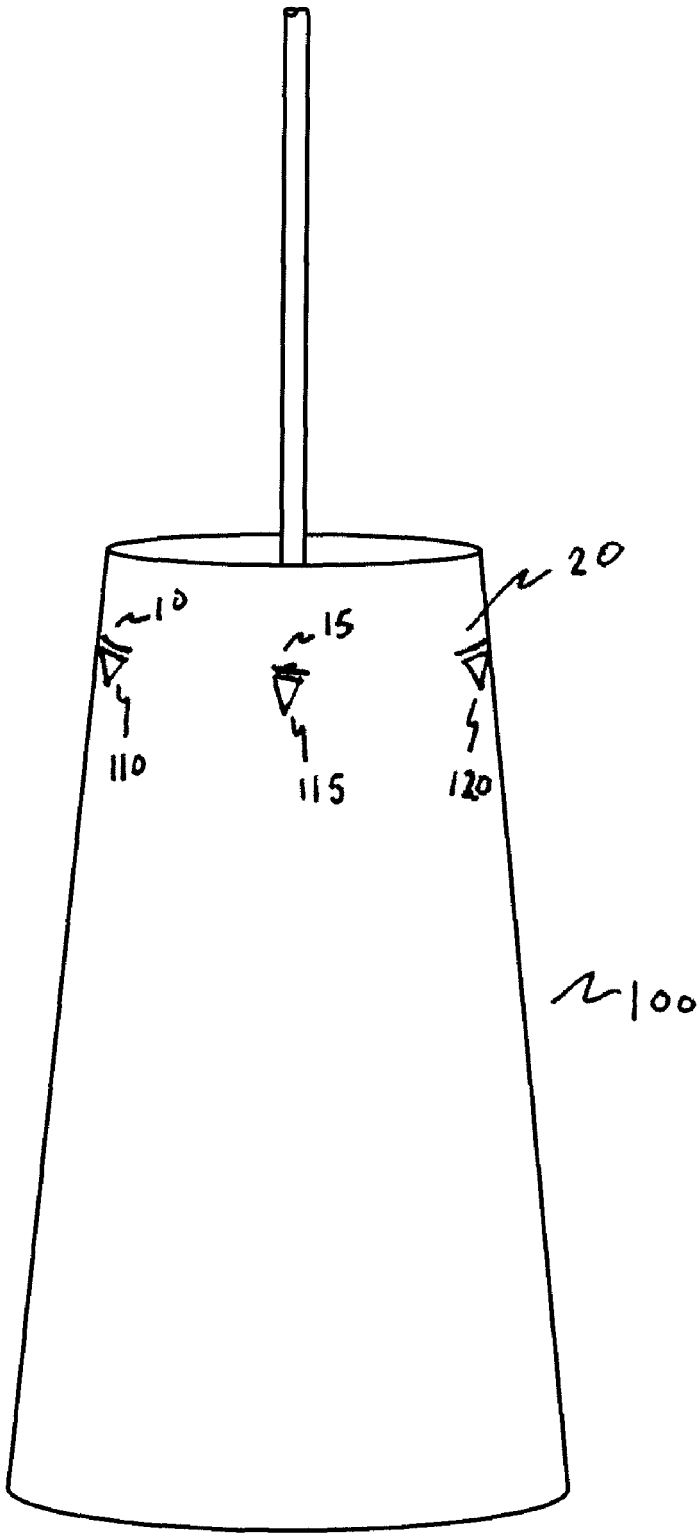
FIG. 5 illustrates a sheet lampshade component used on a hanging lamp in accordance with one embodiment.

FIG. 5 illustrates one embodiment of a sheet lampshade system in use on a hanging lamp (e.g., a pendant, or other suitable hanging lamp). The sheet lampshade system includes a sheet shade component 100 secured by a lampshade spider collar component 200 (not visible). In the embodiment shown, lampshade spider collar component 200 is attached to sheet lampshade component by stops 110, 115, and 120 which are inserted though die cut slits 10, 15 and 20 in sheet lampshade component 100.

It should be appreciated that for the purpose of promoting an understanding of the present invention, references are made in the text to exemplary embodiments of a sheet lampshade system without integrally manufactured frame components only some of which are described herein. It should be understood that no limitations on the scope of the invention are intended by describing these exemplary embodiments. One of ordinary skill in the art will readily appreciate that alternate but functionally equivalent sheet lampshade systems without integrally manufactured frame components may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

What is claimed is:

1. A lampshade system comprising:

a lampshade formed of a flexible substantially flat, unpleated and light transmitting plastic sheet having a printed pattern thereon, the sheet including interengaging releasable attachment elements on opposing edges of the planar sheet so that the sheet may be rolled into a tube and retained in tubular form by the attachment elements with the opposing edges proximate and the attachment elements interengaged, and so that subsequently the attachment elements may be disengaged and the tube unrolled into a flat sheet; and at least one releasably attachable lampshade spider collar component having a ring element receivable around a lamp element to be supported thereby and having arms extending radially from the ring;

wherein said flat sheet further includes at least three holes passing through the flat sheet and engaging ends of corresponding arms when the flat sheet is rolled into a tube to support the tube coaxially about the lamp element when the ring element is received around the lamp element, the lampshade and spider collar attaching so that weight of the lampshade is supported at the contact between the arms and the at least three holes;

wherein the arms each provide a corresponding lampshade retention element positioned at a tip of the arm away from the ring element, the lampshade retention elements each providing a vertically extending surface fitting against a corresponding surface of the lampshade to hold the lampshade substantially centered around the ring element when the arms are fit through the holes.

2. The lampshade system of claim 1, wherein said sheet lamp shade component is die cut.

3. The lampshade system of claim 1, wherein said sheet lampshade component further includes a plurality of material layers.

4. The lampshade system of claim 1, wherein said support arms are telescoping.

5. The lampshade system of claim 1, wherein said support arms are of non-uniform length.

6. The lampshade system of claim 1, wherein said support arms are releasably attachable to the at least one central ring structure.

7. The lampshade system of claim 1, wherein said support arms include pivots adapted to move about the at least one central ring structure.

8. The lampshade system of claim 1, wherein said sheet lampshade component receives said support arms of said lampshade spider collar component so that said lampshade spider collar component supports sheet lampshade component when coupled to a hanging lamp structure.

9. The lampshade system of claim 1, wherein tabs located on opposite ends of said sheet lampshade interlock to hold said sheet lampshade in said second folded position.

10. The lampshade system of claim 1 wherein the interengaging releasable attachment elements are interdigitating tabs cut in the flat sheet material.

11. The lampshade system of claim 1 wherein the tube is selected from the group consisting of a cylindrical tube and a frustroconical tube.

* * * * *